US008327520B2

(12) United States Patent
Hohenester et al.

(10) Patent No.: US 8,327,520 B2
(45) Date of Patent: Dec. 11, 2012

(54) METHOD FOR PRODUCING A COUPLING LINE

(75) Inventors: Wilhelm Hohenester, München (DE); Claus Tremmel, Haar (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 557 days.

(21) Appl. No.: 12/369,498

(22) Filed: Feb. 11, 2009

(65) Prior Publication Data

US 2009/0144964 A1 Jun. 11, 2009

Related U.S. Application Data

(62) Division of application No. 11/667,897, filed as application No. PCT/EP2005/011885 on Nov. 7, 2005, now Pat. No. 7,573,357.

(30) Foreign Application Priority Data

Nov. 22, 2004 (DE) ..... 10 2004 056 259

(51) Int. Cl.
*H04R 31/00* (2006.01)

(52) U.S. Cl. ..... 29/594; 29/25.35; 29/847; 29/827; 216/13; 204/192.32

(58) Field of Classification Search ..... 29/594, 29/25.35, 847, 827, 602.1; 216/13; 204/192.32–192.37
See application file for complete search history.

(56) References Cited

U.S. PATENT DOCUMENTS

| | | | | |
|---|---|---|---|---|
| 2,844,756 | A * | 7/1958 | Diemer | 315/5.49 |
| 3,821,668 | A | 6/1974 | Cohen | |
| 4,480,238 | A | 10/1984 | Iwasaki | |
| 4,633,205 | A | 12/1986 | Jones | |
| 4,857,871 | A | 8/1989 | Harris | |
| 5,294,899 | A | 3/1994 | Tanbakuchi | |
| 5,580,466 | A * | 12/1996 | Tada et al. | 29/827 |
| 5,757,125 | A * | 5/1998 | Furlong et al. | 313/503 |
| 5,959,513 | A | 9/1999 | Parrott et al. | |
| 2002/0001870 | A1 * | 1/2002 | Oda et al. | 438/48 |
| 2002/0002770 | A1 | 1/2002 | Jodo | |
| 2002/0056192 | A1 * | 5/2002 | Suwa et al. | 29/847 |
| 2003/0098755 | A1 * | 5/2003 | Basawapatna et al. | 333/17.1 |

FOREIGN PATENT DOCUMENTS

| | | |
|---|---|---|
| DE | 4309852 | 2/1994 |

OTHER PUBLICATIONS

International Search Report (English and German) including Written Opinion of International Searching Authority (German) for PCT/EP2005/011885; Mailing Date: Oct. 5, 2006.

International Preliminary Report on Patentability with claims annex (English and German) for PCT/EP2005/011885; completion date: Feb. 7, 2007.

(Continued)

*Primary Examiner* — Derris Banks
*Assistant Examiner* — Jeffrey T Carley
(74) *Attorney, Agent, or Firm* — Marshall, Gerstein & Borun LLP

(57) ABSTRACT

A coupling conductor for a YIG filter or YIG oscillator, which may be produced from a metallic foil by eroding, laser cutting and/or etching of a metallic foil. The coupling conductor includes at least one curved section, which at least partially surrounds a YIG element and at least one conductor section.

8 Claims, 2 Drawing Sheets

OTHER PUBLICATIONS

XP-002367334—Recent Advances in Microwave Integrated Circuits Combining Semiconductor and Ferrimagnetic Elements—J. C. Hoover et al.; pp. 39-40; Mar. 20, 1976.

XP-002367335—YIG Resonators and Systems—Electronic Engineering; pp. 47-56; Helszajn; Dec. 1983.

XP-002367336—Low-Loss Gyromagnetic Coupling through Single Crystal Gamets—R. W. DeGrasse; pp. 155S-156S; Apr. 1959.

* cited by examiner

METHOD FOR PRODUCING A COUPLING LINE

CROSS-REFERENCE TO RELATED APPLICATIONS

This is a division of U.S. application Ser. No. 11/667,897, which is the U.S. national phase of PCT/EP2005/011885 filed Nov. 7, 2005, which claims the Convention priority of German application 10 2004 056 259.8 filed Nov. 22, 2004.

BACKGROUND OF THE INVENTION

1. Field of the Invention

The invention relates to coupling lines for use in a YIG band-pass filter or a YIG oscillator and a method for producing such coupling lines, suitable for use in a YIG band-pass filter or a YIG oscillator.

2. Related Technology

YIG band-pass filters or YIG oscillators have at least one resonator, which is preferably constructed as spherical and made from an yttrium iron garnet (YIG). The resonator action is conveyed by means of coupling lines which must be constructed and arranged in such a way that the center point of the resonator and the center point of the bend radius of a coupling line match exactly.

A YIG band-pass filter with appropriately constructed coupling lines is known from U.S. Pat. No. 4,480,238, for example. The variable frequency YIG band-pass filter here has a basic body, comprising slits for accommodating insulated chips which have a conductive coating on one edge, which acts as coupling lines. Furthermore, filter chambers are provided to accommodate the YIG elements. The chips are inserted in the slits via the YIG elements in such a way that the YIG elements are arranged in indentations in the edges provided with the conductive coating. The YIG elements and the chips are fixed in permanent positions.

A disadvantage of the YIG band-pass filter known from the aforementioned document is, in particular, the complicated production of the chips forming the coupling lines. The insulator acting as support must first be appropriately formed and then provided with the conducting coating. This is complicated and liable to rejects, as the coating is susceptible to damage, owing to its small layer thickness.

SUMMARY OF THE INVENTION

The invention therefore provides coupling lines which are easy to produce, unsusceptible to damage and easy to install, and a method for producing such coupling lines.

The invention provides coupling lines for a YIG filter or YIG oscillator with a coupling line, the coupling line having at least one curved section, which at least partially encompasses at least one YIG element, and at least one line section, the coupling line having at least one contact lug constructed in one piece with it, wherein the contact lug acts on the one hand as bonding point of the coupling line in a basic body and on the other hand as fixing for the coupling line in slits in the basic body. The invention also provides a method for producing a coupling line for a YIG filter or a YIG oscillator, the coupling line having at least one curved section, which at least partially encompasses at least one YIG element, and at least one line section, and the coupling line being made of metal foil, said method comprising producing the coupling line by at least one of eroding, cutting, blanking and etching.

BRIEF DESCRIPTION OF THE DRAWINGS

Preferred embodiment examples of the invention are illustrated below as examples using the drawings and explained in greater detail in the following description.

DETAILED DESCRIPTION

Figure 1A:
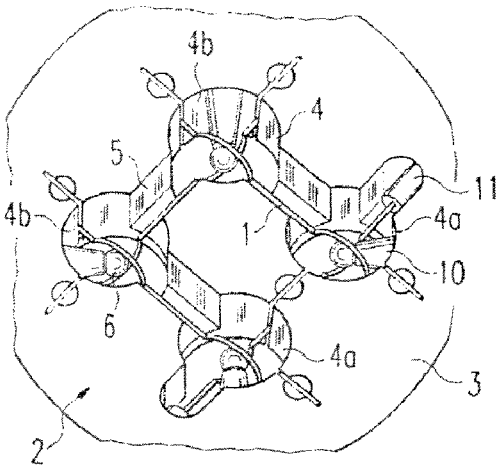
FIG. 1A shows a schematic, perspective illustration of a preferred embodiment example of a basic body of a YIG band-pass filter with resonators and coupling lines.

FIG. 1A shows in a schematic, perspective view an embodiment example of a YIG band-pass filter 2, having a basic body 3 and in the embodiment example four filter chambers 4, constructed in the basic body 3, with the same number of YIG elements 6.

The YIG elements 6 are in this case constructed as spherical from an yttrium iron garnet, mounted on holders 10, by gluing with epoxy resin, for example, and electromechanically coupled by coupling lines 1.

The filter chambers 4 are connected to one another by slits 5, into which the coupling lines 1 are placed. In the embodiment example two of the filter chambers 4 are constructed identically in each case. Coaxial cables 11, via which signals come in and go out, run into the filter chambers 4 designated as 4*a*. The filter chambers 4 designated as 4*b*, on the other hand, have only the YIG elements 6. The number of filter chambers 4*b* is not restricted to two, but may also amount to one or more, so the total number of filter chambers 4 may amount to either three or five or more.

Figure 1B:
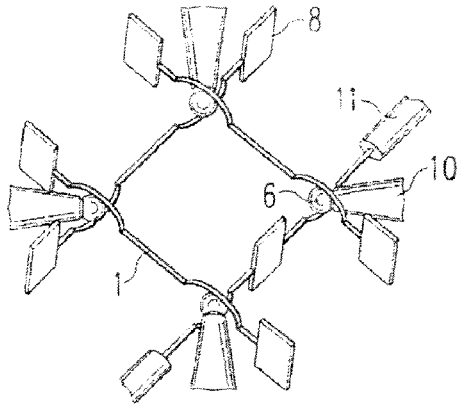
FIG. 1B shows a schematic, perspective illustration of the resonators and coupling lines without the basic body.

FIG. 1B shows for better understanding of the measures according to the invention the arrangement of coupling lines 1 and the YIG elements 6 mounted on their holders 10 without the surrounding basic body 3.

In the embodiment example the coupling lines 1 are designed in two different forms. The coupling line 1 mutually connecting the filter chambers 4*b* is designed as an input and output line 1*a*, while the, in the embodiment example three, further coupling lines 1 are designed as connecting lines 1*b*.

As emerges from FIG. 1B, the coupling lines 1 have contact lugs 8, which on the one hand act as bonding point of the coupling lines 1 in the basic body 3 and on the other hand as fixing of the coupling lines 1 in the slits 5. The contact lugs 8 are formed rectangularly, one edge length of the contact lugs 8 corresponding to approximately the axial thickness of the basic body 3.

Figure 2A:
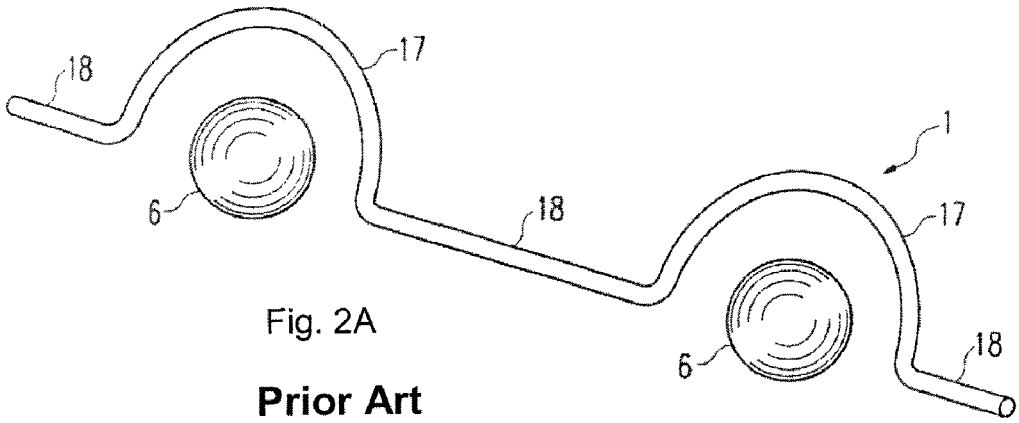
Fig. 2A Prior Art
FIG. 2A shows a schematic illustration of a coupling loop as an example for two resonators according to the prior art.
Figure 2B:
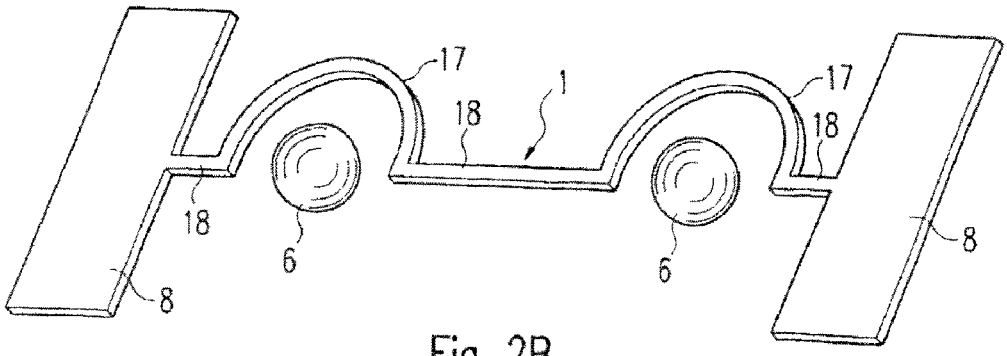
FIG. 2B shows a schematic illustration of an embodiment example of a coupling loop configured according to the invention for two resonators.

If one looks at FIGS. 2A and 2B, it is possible to see in what way the coupling lines 1 according to the invention according to FIG. 2B differ from conventional coupling lines 1 according to FIG. 2A.

The two embodiments have in common the fact that in each case at least one curved section 17 is provided, which in each case at least partially encompasses a YIG element 6 in such a way that a center point of the YIG element 6 coincides with a center point of the curved section 17. Furthermore, at least one line section 18 is provided.

The coupling line 1 according to the prior art illustrated in FIG. 2A is bent from a wire. The YIG elements 6 are here firstly inserted into the basic body 3, not illustrated in greater detail in FIGS. 2A and 2B, and the wire, pre-bent only roughly, is placed into the slits 5. A measurement of the degree of coupling then shows where the coupling line 1 still needs to be further bent. This is done manually by means of a suitable tool. After this there must by renewed checking and sometimes there needs to be further adjustment. For this purpose the YIG filter 2 or YIG oscillator has to be opened and then reassembled each time to perform the measurement. The method is therefore extremely complicated and often even results in the workpiece having to be completely rejected after several iterations, because no satisfactory coupling is achieved.

By contrast, the coupling lines 1 configured according to the invention according to FIG. 2B are made of a metal foil 7 by suitable methods, such as etching, eroding, cutting, in particular laser cutting or water-jet cutting, and/or blanking, and mounted. Correct positioning of the YIG elements 6 relative to the coupling lines 1 then takes place.

The foil 7 comprises a copper-beryllium alloy, in order to meet both the requirements for elasticity and for stability. The thickness of the foil 7 preferably amounts to 10 μm to 100 μm, more preferably 25 μm to 75 μm, and most preferably approximately 50 μm.

Production of the coupling lines 1 from the foil 7 is done in several processing steps. Firstly the foil 7 is cleaned and then a positive resist is applied to both sides at an adjustment accuracy of approximately 5 μm in a layer thickness of approximately 5 μm, to create a mask. This is followed by the production of the coupling lines 1, for example by sputter etching with iron chloride ($FeCl_3$). Then the foils in the form of a support 9 with a previously established number of coupling lines 1 are freed of remnants of varnish and provided galvanically with a gold coating of approximately 5 μm. Then a hardening process takes place for an hour at 325° C., for example. The coupling lines can then be released from the foil support 9 and built in.

Because of the production method described, the coupling lines 1 have a permanent shape with a precisely defined radius of curvature in the curved sections 17 with even curvature. The YIG elements 6 are then aligned relative to the coupling lines 1. This is simpler than the prior art and associated with an appreciably smaller outlay, because the accuracy of production with the coupling lines 1 configured according to the invention is appreciably greater than with manually bent coupling lines 1.

Figure 3A:
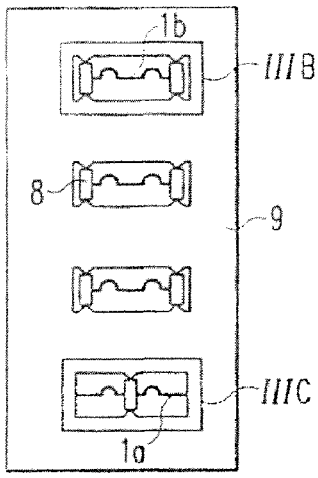
FIGS. 3A-C show schematic illustrations of coupling lines configured according to the invention during the production process before detaching.

FIG. 3A shows in a schematic illustration a support 9 containing the coupling lines 1 required for a YIG band-pass filter 2 with four YIG elements 6.

As mentioned above, in the embodiment example the coupling lines 1 are in the form of an input and output line 1*a* and three connecting lines 1*b*. The former is arranged right at the bottom of the foil support 9 in FIG. 3A and the latter above it.

Figure 3B:
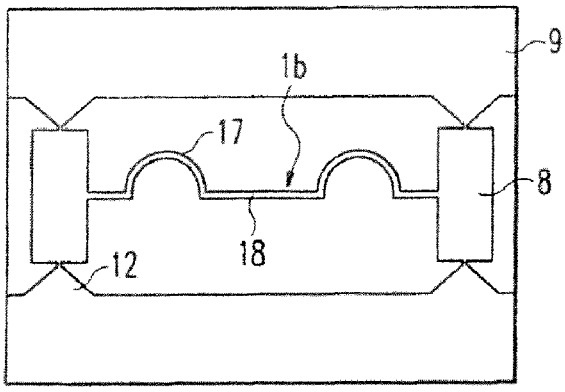
Figure 3C:
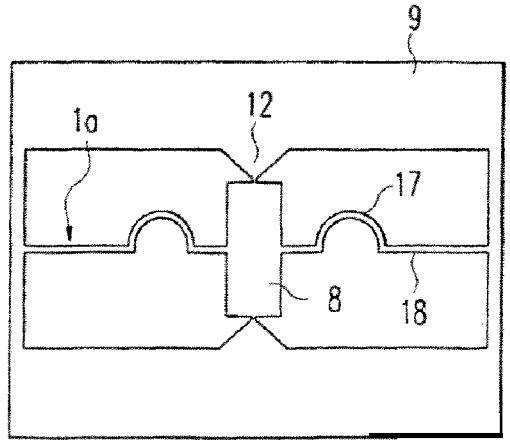

FIGS. 3B and 3C show the parts cut out of the support 9 designated as IIIB and IIIC in FIG. 3A. In FIG. 3B one of the three connecting lines 1*b* is illustrated, while FIG. 3C shows the input and output line 1*a*.

It can be seen from FIGS. 3B and 3C that the coupling lines 1 are held in the support 9, after the process of etching, cutting, blanking or eroding from the foil 7 before being detached, by webs 12 which are constructed on the contact lugs 8. When the coupling lines 1 are detached the coupling lines 1 are separated from the support 9 by breaking the webs 12. After detaching, the coupling lines 1 are mounted in the basic body 3 according to their shape and fixed in the basic body 3 by soldering, welding or some other connecting method which maintains the electric conductivity.

The invention is not confined to the embodiment example illustrated and is suitable for YIG filters 2 or YIG oscillators configured in any way. The individual features can be combined with one another in any way.

The invention claimed is:

1. Method for producing a coupling line for a YIG filter or a YIG oscillator, the coupling line having at least one curved section, which at least partially encompasses at least one YIG element, and at least one line section, wherein the coupling line being made of a metal foil, said method comprising:

producing the coupling line by at least one of eroding, cutting, blanking, and etching;

gilding the coupling lines; and subsequently hardening the coupling lines for a duration of approximately one hour at a temperature of approximately 325° C.

2. Method according to claim 1, comprising producing the coupling line by sputter etching using iron chloride ($FeCl_3$).

3. Method according to claim 1, wherein the method comprises:

cleaning the foil, varnishing the foil, sputter etching the coupling lines from the foil, removing the varnish from the coupling lines, and detaching the coupling lines from the foil.

4. Method according to claim 3, wherein varnishing the foil comprises varnishing a front of the foil and a back of the foil.

5. Method according to claim 3, wherein the thickness of the varnish during varnishing is approximately 5 μm.

6. Method according to claim 4, comprising applying the varnish in the form of positive resist.

7. Method according to claim 3, comprising gilding up to a layer thickness of approximately 5 μm.

8. Method according to claim 3, comprising producing the coupling lines for a basic body of a YIG band-pass filter or YIG oscillator in each case as a unit in a foil support.

* * * * *